US007845719B2

(12) United States Patent
Flannery

(10) Patent No.: US 7,845,719 B2
(45) Date of Patent: Dec. 7, 2010

(54) ADJUSTABLE HEIGHT HOOK ON HIGH CHAIR

(75) Inventor: Mark A Flannery, Lakeville, MN (US)

(73) Assignee: Regalo International, LLC, Prior Lake, MN (US)

( * ) Notice: Subject to any disclaimer, the term of this patent is extended or adjusted under 35 U.S.C. 154(b) by 283 days.

(21) Appl. No.: 12/080,017

(22) Filed: Mar. 31, 2008

(65) Prior Publication Data

US 2009/0243349 A1 Oct. 1, 2009

(51) Int. Cl.
*A47D 1/10* (2006.01)

(52) U.S. Cl. ..... 297/174 CS; 297/174 R; 297/256.16

(58) Field of Classification Search ..... 297/174 CS, 297/174 R, 143, 142, 141, 256.16, 344.18, 297/344.12, 215.13; 108/97
See application file for complete search history.

(56) References Cited

U.S. PATENT DOCUMENTS 2,493,187 A * 1/1950 Ducey ..... 297/174 CS
2,540,672 A * 2/1951 Holmes ..... 297/174 CS
2,692,637 A * 10/1954 Rainwater ..... 297/344.18
2,707,987 A * 5/1955 Gibson ..... 297/174 CS
3,126,226 A * 3/1964 Johnson ..... 297/174 CS
3,157,432 A * 11/1964 Watkins ..... 297/254
4,469,373 A * 9/1984 Simmons et al. ..... 297/174 CS
4,629,247 A * 12/1986 Wu ..... 297/174 CS
4,700,988 A * 10/1987 Meyers ..... 297/254
6,273,503 B1 * 8/2001 Cheng ..... 297/174 CS
6,679,549 B2 * 1/2004 Catelli ..... 297/174 CS
7,591,506 B2 * 9/2009 Flannery ..... 297/174 CS
2006/0162625 A1 * 7/2006 Mayben ..... 108/97
2007/0040430 A1 * 2/2007 Flannery ..... 297/271.6

* cited by examiner

*Primary Examiner*—Joseph F Edell

(57) ABSTRACT

A hook on high chair that includes a base unit that engages the lip of a table top and a seat unit that engages a seat for a child. The base unit and seat unit slide relative to each other such that the seat of the seat unit is adjustable in height so as to customize the hook on high chair for relatively small children such as infants or relatively large children such as toddlers. The base unit includes a J-shaped lower tube that includes a turn knob and an upper tube that includes a resilient foot for opposing the turn knob. The lower and upper tubes are fixed via a joint. The seat unit includes a vertically extending tube slideably adjustable in the joint via a spring biased pin. The seat unit includes a cantilevered portion that carries the seat.

12 Claims, 3 Drawing Sheets

ADJUSTABLE HEIGHT HOOK ON HIGH CHAIR

FIELD OF THE INVENTION

The present invention generally relates to hook on high chairs, particularly to hook on high chairs having a seat unit that is engagable to and disengagable from a base unit, and specifically to such a hook on high chair having a seat unit that is adjustable in height relative to the base unit and thus adjustable in height relative to the table top.

BACKGROUND OF THE INVENTION

A conventional high chair is a chair that includes relatively long legs and an elevated seat. The child sits on the elevated seat. Sometimes the conventional high chair includes a tray. Sometimes, with no tray or with the tray detached, the conventional high chair is slid close to the table top.

A hook on high chair engages the table top of a table. The hook on high chair includes no legs that reach to the floor. The hook on high chair may have a system of clamps or other apparatus for engaging the table top of a table.

SUMMARY OF THE INVENTION

A feature of the present invention is the provision in a hook on high chair having a frame with a base unit and a seat unit, of the seat unit being engagable to and disengagable from the base unit such that the base unit can remain at the table while the seat unit that protrudes out into room space can be removed from the table between meal times.

Another feature of the present invention is the provision in such a hook on high chair, of the base unit and seat unit being slideably adjustable relative to each other such that the seat of the hook on high chair is adjustable in height relative to the table top to which the hook on high chair hooks on.

Another feature of the present invention is the provision in such a hook on high chair, of the base unit including a vertically extending lower base tube portion, of the seat unit including a vertically extending seat tube portion, and of one of the vertically extending lower base tube portion and vertically extending seat tube portion sliding within the other of the vertically extending lower base tube portion and vertically extending seat tube portion such that the seat unit is adjustable in height relative to the base unit and relative to the table top.

Another feature of the present invention is the provision in such a hook on high chair, of a joint between the vertically extending lower base tube portion and the vertically extending seat tube portion, wherein the joint comprises a spring biased pin, wherein the vertically extending lower base tube portion and vertically extending seat tube portion include alignable openings, wherein the joint fixes the vertically extending lower base tube portion and vertically extending seat tube portion relative to each other when the spring biased pin is engaged in two alignable openings, and wherein the joint permits the vertically extending lower base tube portion and vertically extending seat tube portion to slide relative to each other when the spring biased pin is disengaged from at least one of such two alignable openings.

Another feature of the present invention is the provision in such a hook on high chair, of the joint further comprising an axial overlap between the vertically extending lower base tube portion and the vertically extending seat tube portion, of the vertically extending lower base tube portion including an upper end, and of such axial overlap extending at least a distance between such spring biased pin and such upper end such that the base unit provides a seating or receptor for the seat unit before the spring biased pin is engaged in such two alignable openings.

Another feature of the present invention is the provision in such a hook on high chair, of an upper base tube having proximal and distal ends relative to the seat, of a lower base tube having proximal and distal ends relative to the seat, of a foot engaged to the distal end of the upper base tube, of a turn knob engaged to the distal end of the lower base tube and opposing the foot, and of a joint engaging the proximal ends of the upper and lower base tubes.

Another feature of the present invention is the provision in such a hook on high chair, of the base unit including a lower base tube, of the lower base tube being generally J-shaped such that the lower base tube includes a pair of upwardly extending tube portions, of each of the upwardly extending tube portions including an upper end, and of one of the upper ends being offset horizontally relative to the other of the upper ends such that, when the hook on high chair is engaged to the table top, one of the upper ends is disposed at a greater height than the other of the upper ends.

Another feature of the present invention is the provision in such a hook on high chair, of the seat unit having a cantilevered portion that carries the seat in which the child sits.

Another feature of the present invention is the provision in such a hook on high chair, of a vertically extending seat tube portion that engages the base unit, of a cantilevered portion that engages the vertically extending seat tube portion and projects away from the vertically extending seat tube portion, and of the cantilevered portion engaging the seat such that the seat hangs from the cantilevered portion and such that the cantilevered portion carries a load of the child in the seat.

Another feature of the present invention is the provision in such a hook on high chair, of the cantilevered portion being rigidly fixed to said vertically extending seat tube portion at a right angle, of the seat including at least one sleeve, of the cantilevered portion including tube sections engagable to and disengagable from each other, and of the cantilevered portion engaging said at least one sleeve, such that the seat is slideable off the cantilevered portion when said tube sections are disengaged, and such that the seat is slideable off the seat unit without sliding said sleeve through said right angle.

An advantage of the present invention is that kitchen or dining room space is saved. Since the base unit may remain at the table and since the seat unit may, independently of the base unit, be removed from the table, there is no seat unit protruding into room space.

Another advantage of the present invention is better engagement with the family. Since the seat unit is adjustable in height relative to the base unit and table top, the infant or toddler is at the table top at the right height, the child can better engage in conversation and contact with his family, and the child can better reach his or her dinner such that mess is minimized with or without dining utensils.

Another advantage of the present invention is that the seat unit engages the base units even if the spring biased pins are not engaged. For example, a first step in setting up the hook on high chair may be engaging the base units to a table top. The base units are independent of each other and so, in this preliminary step, the base units may set at merely an estimated distance apart from each other. A second step may be engaging the seat unit to the base unit. Here the vertically extending seat tube portions of the seat unit may be set into the vertically extending lower base tube portions of the base unit without operating the spring biased pins. In such a case, the depth of such an engagement, or axial overlap between the vertically extending lower base tube and vertically extending seat tube portion, is sufficient to keep the seat unit engaged with the base units. In such a case, such an axial overlap is a joint in and of itself and is further a guide that preliminary sets the pair of vertically extending seat tube portions into the pair of vertically extending lower base tube portions. In such a case, the spring biased pins, extending into the interior of the vertically extending lower base tube portions, act as stops against the lower ends of the vertically extending seat tube portions. Then, with the hands free of the seat unit, the base units may be pivoted to different angles or moved as a whole to a slightly different location on the table top. Then, with the hands free of the seat unit but with the seat unit engaged to the base units, the turn knobs may be operated to the desired tightness. Then, with the hands free of the seat unit but with the seat unit engaged to the base units, the spring biased pins may be pulled out to permit the seat unit to drop to the desired height, whereupon the pins may be permitted to engage aligned openings of the vertically extending seat tube portions and vertically extending lower base tube portions to secure the seat unit to the base units.

Another advantage of the present invention is that storage and shelf space is minimized. One feature contributing to this advantage includes the provision of independent parts. For example, the right side base unit is independent of the left side base unit. Each of the cantilevered portions can be removed from its respective base unit and broken down into tube sections. The seat can be removed from the tube sections.

Another advantage of the present invention is that the hook on high chair is simple and inexpensive to manufacture and easily and readily assembled in the end use environment.

DETAILED DESCRIPTION

Figure 1A:
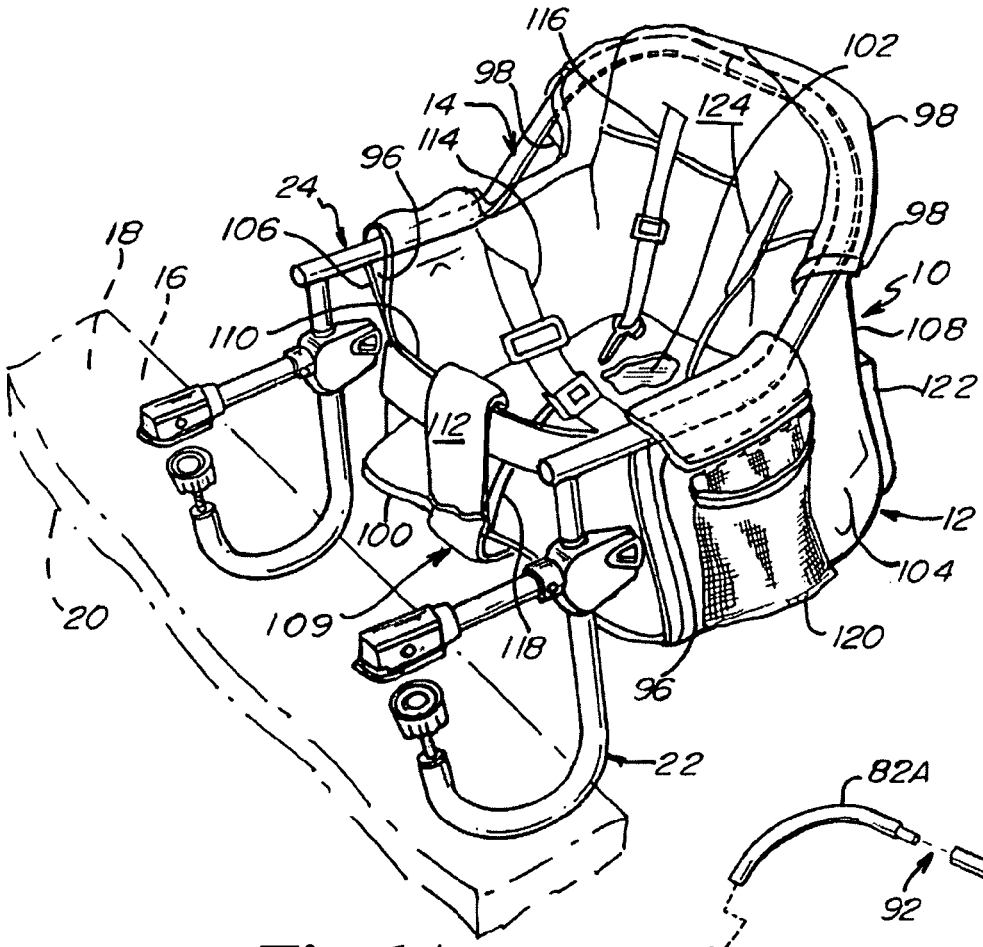
FIG. 1A is a perspective view of the present adjustable height hook on high chair, shows a table top of a table in phantom, and shows the base units of the adjustable height hook on high chair engaging the table top.
Figure 1B:
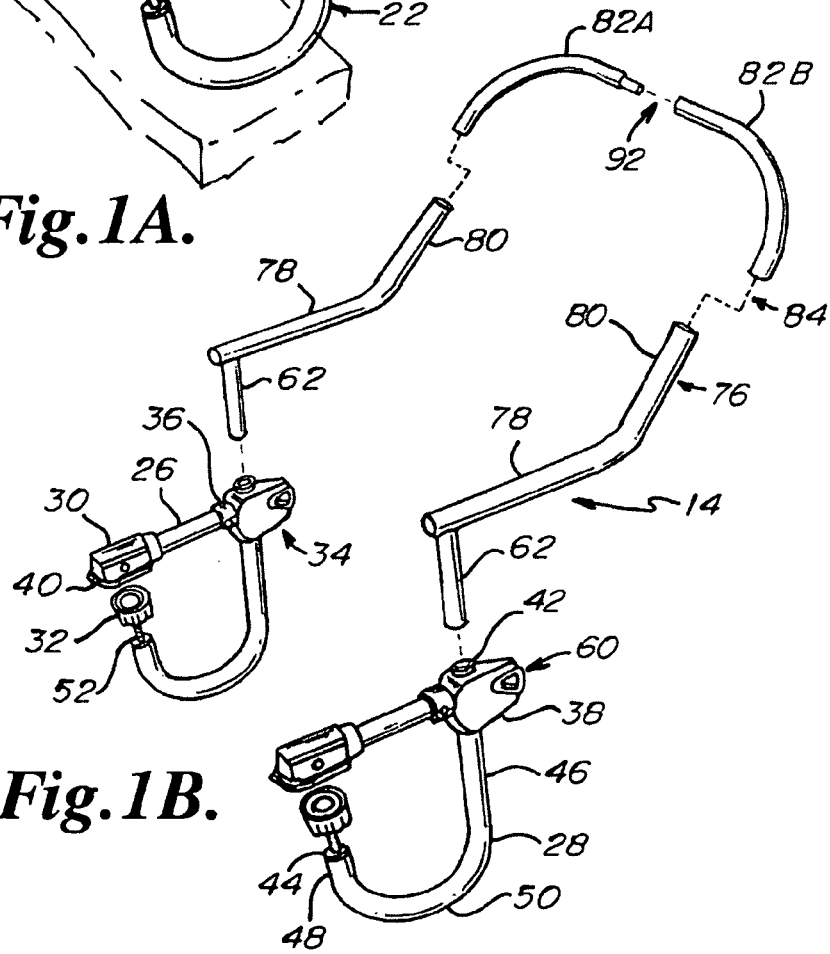
FIG. 1B is a perspective exploded view of the frame of the adjustable height hook on high chair of FIG. 1A, and shows the base units and the seat unit of the frame.

As shown in FIG. 1A, the present adjustable height hook on high chair is indicated in general by the reference numeral 10. The hook on high chair 10 includes a seat 12 for seating a child and a frame 14 that engages the seat 12 and that further engages a lip 16 of a table top 18 of a table 20. The frame 14 includes a pair of independent base units 22, each of which engages the lip 16 of the table top 18. The frame 14 further includes a seat unit 24 that engages the seat 12. The seat unit 24 is engagable to and disengagable from the base units 22, such as sliding the seat unit 24 up and out of the base units 22, such that the base units 22 can remain at the table 20 while the seat unit 24 that protrudes out into room space can be removed from the table 20 such as between meal times.

Base unit 22 generally includes an upper base tube 26, a lower base tube 28, a foot 30, a turn knob 32, and a joint 34. The upper base tube 26 is a linear tube having proximal and distal ends relative to the seat 12. The proximal end is rigidly fixed, such as with a transverse pin, to a collar 36 that is integral with a body 38 of the joint 34. The distal end of the upper base tube 26 is rigidly affixed, such as with a transverse pin, to the foot 30. The foot 30 includes a sole 40 that includes a roughened undersurface that confronts and makes contact with the upper surface of the table top 18. At least the sole 40 is formed of an elastomeric or resilient material such that, when the turn knob 32 is turned to draw the turn knob 32 and foot 30 towards each other, the sole or resilient portion 40 is squeezed so as to make a tight connection therebetween while minimizing damage to the table top 18. Preferably, the foot 30 as a whole is formed of one material that is elastomeric or resilient such that the foot as a whole is integral and one-piece.

The lower base tube 28 is generally formed in the shape of a J. That is, the lower base tube 28 includes a proximal end 42 and a distal end 44 relative to the seat 12. The proximal ends 42 and 44 are the respective upper ends of respective vertically extending lower base tube portions 46, 48 that are integrally joined by a medial curved portion 50. Upper proximal end 42 is offset horizontally relative to upper distal end 44 such that, when the hook on high chair 10 is engaged to the table top 18, upper proximal end 42 is disposed at a greater height than the upper distal end 44.

The vertically extending lower base tube portion 48 threadingly receives a threaded shaft 52 which rigidly mounts the turn knob 32 such that when the turn knob 32 is turned, the threaded shaft 52 is turned into or out of the upwardly extending tube portion 48. The portion of the upwardly extending tube portion 48 that engages the threaded shaft 52 is an endless circular inner edge of an inwardly turned flange at the very top of the upper end 44.

The vertically extending lower base tube portion 46 rises through the joint body 38 and includes an exposed portion or lip jutting slightly up from the upper surface of the joint body 38 such that when a metal tube section of the seat unit 24 is inserted into the vertically extending lower base tube portion 46, it is likely that metal of the seat unit 24 meets metal of the base unit 22 instead of metal of the seat unit 24 meeting and damaging plastic of the joint body 38. The vertically extending lower base tube portion 46 is rigidly fixed to the joint body 38 such as with pins clamping opposing half sections of the joint body 38 tightly to the vertically extending lower base tube portion 46. The vertically extending lower base tube portion 46 and thus the J-shaped lower base tube 28 as a whole may, if desired, be rigidly fixed directly to the upper base tube 26 such as by a weld, with the joint body 38 surrounding and reinforcing such a welded joint.

Figure 3A:
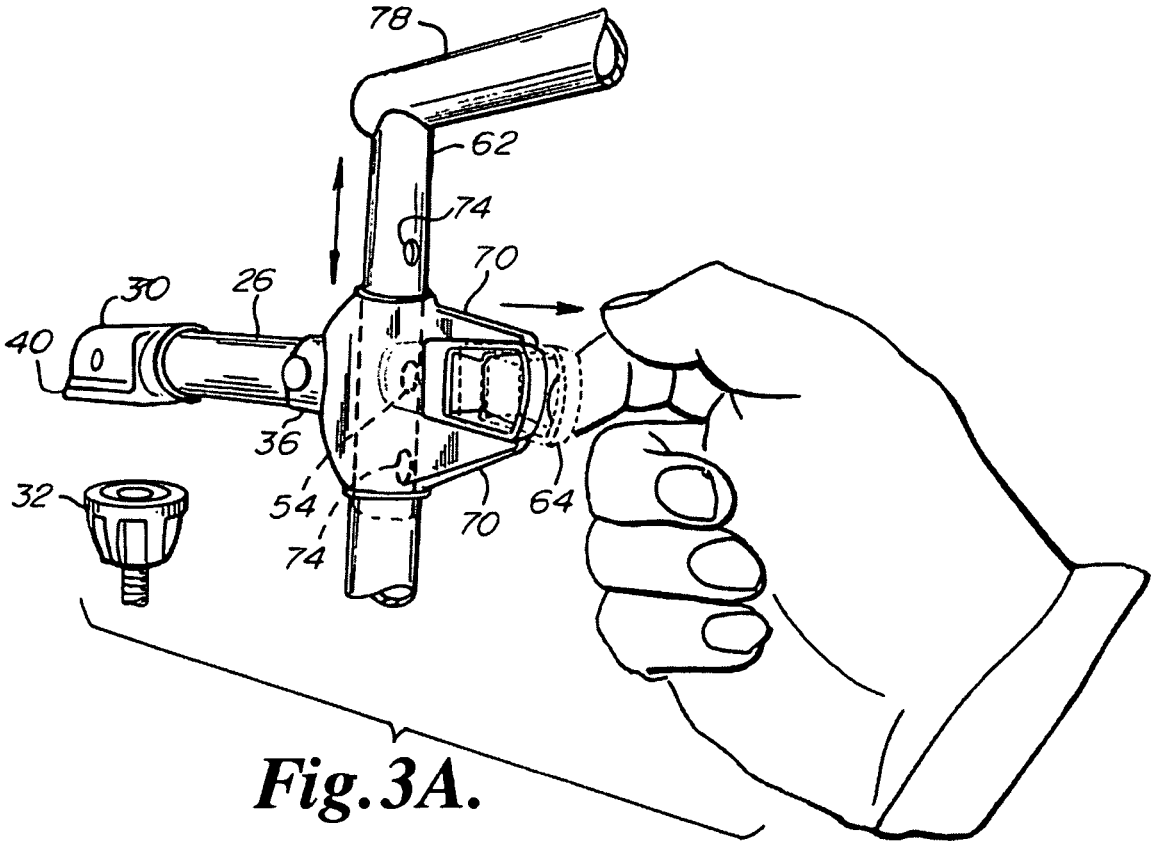
FIG. 3A is a detail view of the joint of the adjustable height hook on high chair of FIG. 1A, and shows how the spring biased pin may be pulled to a disengagement position with a finger so as to permit the seat unit to be taken out of the base unit or so as to permit the seat unit to be adjusted up and down.

The vertically extending lower base tube portion 46 includes an opening 54 shown in FIG. 3A. The opening 54 is disposed within the joint body 38. The opening 54 is transverse of, and formed in a side of the vertically extending lower base tube portion 46 that is opposite of, the upper base tube 26. The opening 54 is aligned on an axis of the linear extending upper base tube 26.

Figure 2A:
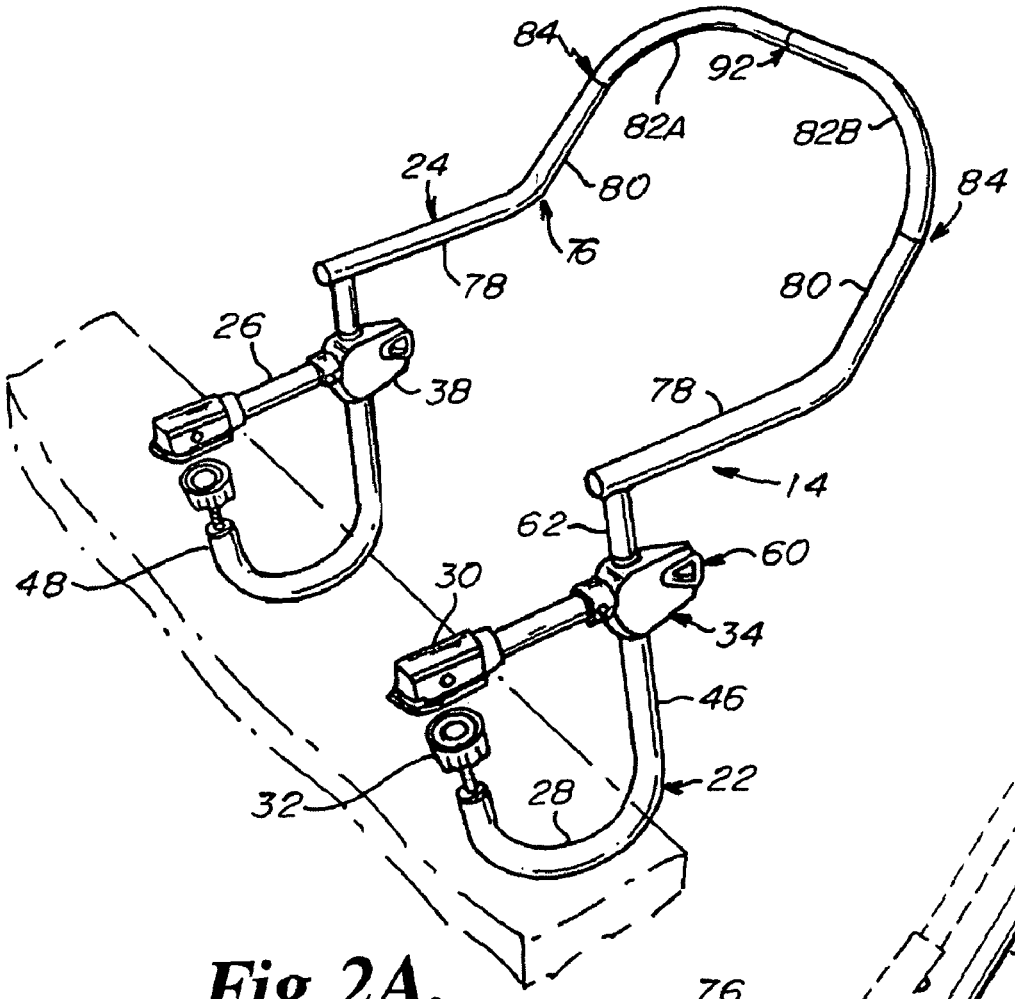
FIG. 2A is a perspective assembled view of the frame of the adjustable height hook on high chair of FIG. 1B, shows a table top of a table in phantom, and shows the base units engaging the table top.
Figure 2B:
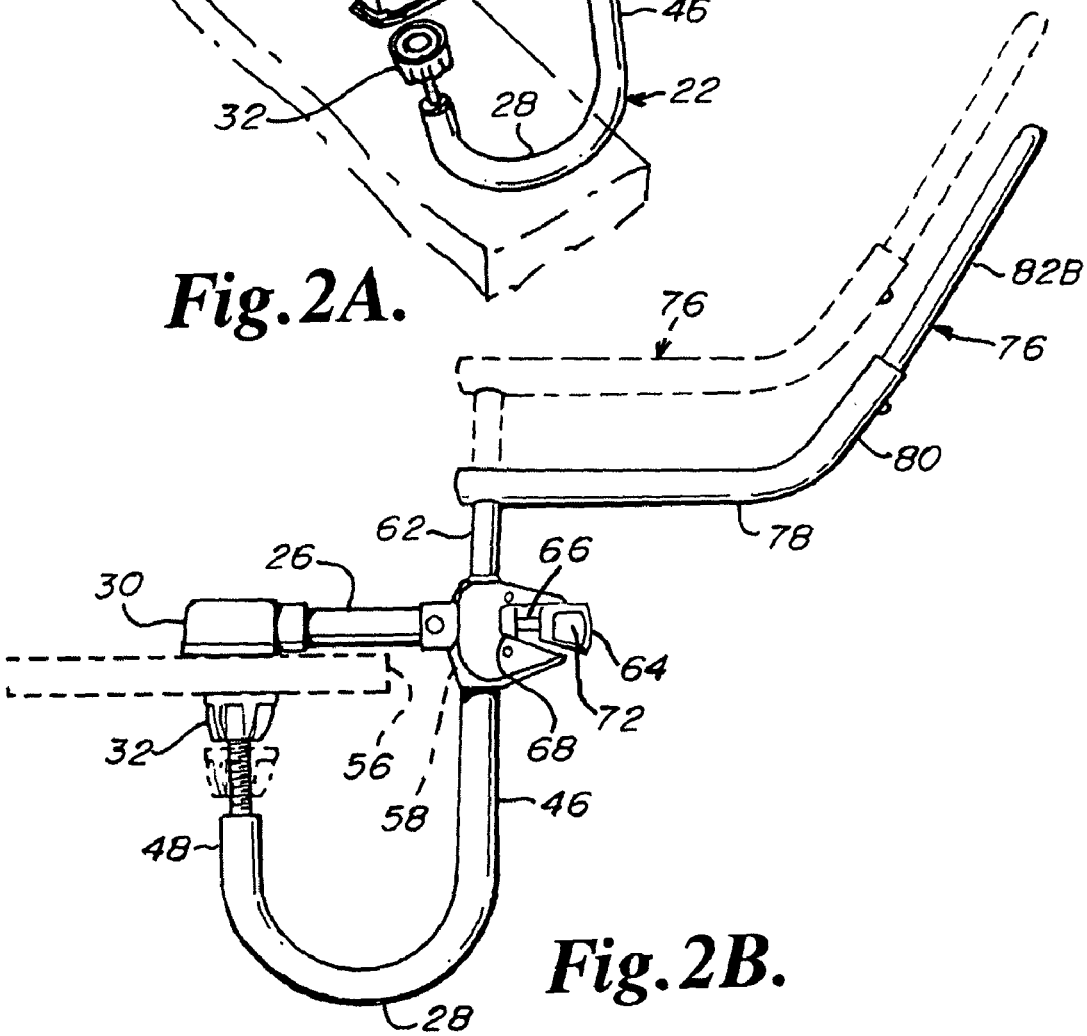
FIG. 2B is a side elevation view of one side of the assembled frame of the adjustable height hook on high chair of FIG. 2A, shows a table top of a table in phantom, shows in phantom how the seat unit may be adjusted up and down, shows in phantom how the turn knob of the base unit may be loosened and tightened, and shows the spring biased pin in a disengaged position to permit the seat unit to be taken out of the base unit or to permit the seat unit to be adjusted up and down.

The upper and lower base tubes 26, 28 are coplanar with each other. The lip 16 of the table top 18 is received between the upper and lower base tubes 26, 28 and within the base unit 22 as a whole. The lip 16 of the table top 18 includes an edge 56 that can confront and make contact with an oblique outer face of the joint body 38, as shown in FIG. 2B. The foot 30 is generally vertically aligned with the turn knob 32 such that direct opposing pressure is exerted upon direct opposing portions of the upper and under surfaces of the table 20.

Joint 36 includes one or more of the joint body 38, any welded fixed joint that may be present between the upper and lower base tubes 26, 28, a spring biased pin mechanism 60, the vertically extending lower base tube portion 46 of the base unit 22, and a vertically extending seat tube portion 62 that is slidingly received in the vertically extending lower base tube portion 46.

The spring based pin mechanism 60 includes, as shown in FIGS. 2B and 3A, a finger grip or finger handle 64, a pin 66, and a coil spring housed in a section 68 of the joint body 38. The coil spring is disposed about the pin 66 and is compressed when the finger grip 64 is pulled outwardly. When the finger grip 64 is released, the coil spring is biased to extend and return the pin 66 inwardly. The finger grip 64 is of a different color from a remainder of the joint 36 and is preferably colored a red or a shade of red. The finger grip 64 is disposed transversely of the upper base tube 26 and the pin 66 is axially aligned with the axis of the upper base tube 26. The joint body 38 includes a pair of rearwardly projecting sections 70, each generally formed in the shape of a triangle. These sections 70, along with section 68, form a seat for the finger grip 64 to be seated when the pin 66 is biased inwardly so as to be engaged. Finger grip 64 includes a closed opening 72 having a size about the height and width of a first finger.

The vertically extending seat tube portion 62 includes a set of three openings 74 spaced axially from each other and formed in the rear side of the tube portion 62 such that the openings 74 are opposite the upper base tube 26 and confront the spring biased pin mechanism 60, as shown in FIG. 3A. FIG. 3A shows two of the openings 74, and the third opening 74 in FIG. 3A is aligned with opening 54 of the vertically extending lower base tube portion 46. The vertically extending seat tube portion 62 is slidingly received in the vertically extending lower base tube portion 46 and any of the three openings 74 can be aligned with opening 54. When one of the three openings 74 are so aligned with opening 54, the finger grip 64 can be operated such that the pin 66 can slide into and out of at least opening 74 of the aligned openings 54, 74, whereupon the vertically extending seat tube portion 62 is slideable relative to the vertically extending lower base tube portion 46. In other words, the spring biased pin mechanism 60 can be structured such that pin 66 can slide out of the aligned opening 74, with the head of the pin remaining in opening 54. Such permits the vertically extending seat tube portion 62 to freely slide up and down in the vertically extending lower base tube portion 46 while minimizing axial travel of the pin 66.

When the pin 66 has returned to its rest position and when the pin 66 engages one opening 74 and the opening 54, then the vertically extending seat tube portion 62 is locked relative to the vertically extending base tube portion 46 and the seat unit 24 is locked relative to the base unit 22. Such a configuration can be unlocked by pulling on the finger grip 64 to pull the pin 66 from the opening 74.

In the case where the seat unit 24 has been put away independently of the base unit 22, or in the case where the lower end of the vertically extending seat tube portion 62 has not been inserted down to the elevation of the pin 66, the pin 66 in the rest position blocks the cylindrical opening inside of vertically extending base tube portion 46. In this position, the pin 66 has returned to its rest position and engages only opening 54 and no opening 74. In this position, pin 66 acts as a stop and the vertically extending seat tube portion 62 cannot be inserted into the vertically extending lower base tube portion 46 past the pin 66. In this position, there is a substantial overlap between the vertically extending seat tube portion 62 and the vertically extending lower base tube portion 46. This substantial overlap is itself a joint that provides an engagement between the seat unit 24 and the base unit 22, and this position provides a temporary or precursor type or hands free type of position while attention is being paid to operating the finger grips 64 or to other matters such as operating or moving the base units 22. In other words, no hands are required to hold the seat unit 24 in this position. One hand can operate one finger grip 64 and, at the same time, the other hand can operate the other finger grip 64 while the seat unit 24 is held in the hands free position by the substantial overlap of tube portions 46 and 62.

Seat unit 24 includes a pair of the vertically extending seat tube portion 62. Seat unit 24 further includes a pair of cantilevered portions 76. Each of the cantilevered portions 76 includes a generally horizontally extending linear tube section 78, an upwardly extending linear tube section 80, and a curved tube section 82A or 82B. Base unit 22 as a whole is coplanar with its respective vertically extending seat tube portion 62, generally horizontally extending linear tube section 78, and upwardly extending linear tube section 80. Each of the base units 2 generally defines a plane and the curved tube sections 82A and 82B lie generally between the two planes.

The generally horizontally extending linear tube section 78 is rigidly fixed to the upper end of vertically extending seat tube portion 62. A proximal end of the horizontally extending linear tube section 78 extends slightly forwardly of the upper end of the vertically extending seat tube portion 62. The horizontally extending linear tube section 78 includes a distal end that is distal relative to the vertically extending seat tube portion 62.

The upwardly extending linear tube section 80 is integral and one-piece with the horizontally extending linear tube section 78. The upwardly extending linear tube section 80 extends from the distal end of the horizontally extending tube section 78 and forms an obtuse angle with the horizontally extending linear tube section 78. The upwardly extending linear tube section 80 includes a distal end distal relative to the vertically extending seat tube portion 62.

Each of the curved tube sections 82A and 82B includes two ends. One of the ends is slideably engagable with the distal end of the upwardly extending linear tube section 80. The other of the ends of the curved tube section 82A, 82B is slideably engagable with an end of the other curved tube section 82A, 82B of the other cantilevered portion 76. The upwardly extending linear tube section 80 and the respective curved tube section 82A or 82B are coplanar with each other.

Figure 3B:
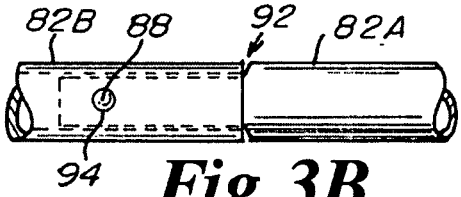
FIG. 3B is a detail, partially phantom view of a connection of tube sections of the frame of the seat unit of the adjustable height hook on high chair of FIG. 1B.
Figure 3C:
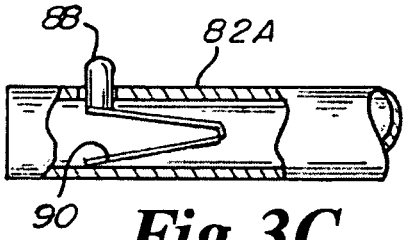
FIG. 3C is a detail, partially cut away view of a tube section of the frame of the seat unit of the adjustable height hook on high chair of FIG. 1B where the tube section includes a button pin having a bent flat spring.
Figure 3D:
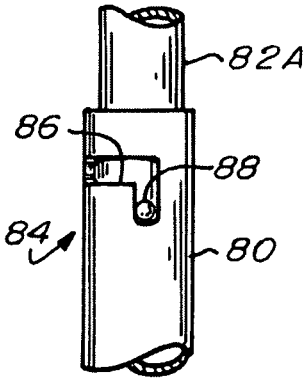
FIG. 3D is a detail view of a connection of tube sections of the frame of the seat unit of the adjustable height hook on high chair of FIG. 1B.

A connection 84 between the distal end of the upwardly extending linear tube section 80 and the curved tube section 82A is shown in FIG. 3D. Curved tube section 82A is slideably received inside of upwardly extending linear tube section 80 and locked thereto by the connection 84. This connection 84 includes an L-shaped slot 86 formed in a distal end portion of the upwardly extending linear tube section 80 and a button pin 88 housed within a proximal end portion of curved tube section 82A, as shown in FIG. 3C. Button pin 88 includes a bent flat spring 90 that biases the button pin 88 outwardly. Button pin 88 is pressed down with a finger or thumb to slide the curved tube section 82A into the upwardly extending linear tube section 80, whereupon the button pin 88 pops out into the L-shaped slot 86. To disconnect the tube sections 80 and 82A from each other, the button pin 88 is pressed down with a finger or thumb to slide the curved tube section 82A out of the upwardly extending linear tube section 80. Preferably, to place the cantilevered portion 76 in its appropriate configuration, the button pin 88 is fed or slid to the proximal end of the axially extending portion of the L-shaped slot 86, as shown in FIG. 3D.

A connection 92 between the curved tube sections 82A and 82B is shown in FIG. 3B. Here the curved tube sections 82A and 82B are slightly different. One curved tube section is represented by reference character 82A. The other curved tube section is represented by reference character 82B. Connection 92 is a male-female connection, where curved tube section 82A includes a male portion and where curved tube section 82B includes a female portion. The male portion of curved tube section 82A includes a button pin 88 and its underlying flat spring 90. The female portion of curved tube section 82B includes an opening 94 through which the button pin 88 can pop to lock the curved tube sections 82A and 82B with each other. To connect the curved tube sections 82A and 82B, button pin 88 is depressed and the male and female portions of the respective curved tube sections 82A and 82B are slid together until the button pin 88 pops into opening 94, whereupon the curved tube sections 82A and 82B are locked together. To disconnect the curved tube sections 82A and 82B, button pin 88 is depressed and the male and female portions of the respective curved tube sections 82A and 82B are slid apart.

The pair of cantilevered portions 76 carry the seat 12. Seat 12 includes a pair of first sleeves 96, each of which engage one horizontally extending linear tube section 78. Seat 12 further includes a second sleeve 98, which engages the upwardly extending linear tube sections 80 and the curved tube sections 82A and 82B. The seat 12 hangs from the cantilevered portions 76 via the sleeves 96, 98. The weight of a child in the seat 12 is borne by the cantilevered portions 76.

The seat 12 includes a seat bottom 100. The seat bottom 100 may include encased therein a rigid or semirigid plate 102 that generally extends to and between the front and rear edges of the bottom 100 and that generally extends to and between the right side and left side edges of the bottom 100.

The seat 12 further includes a left side 104, a right side 106, and a seat back 108. The first sleeves 96, the second sleeve 98, the seat bottom 100, the left side 104, the right side 106, and the seat back 108 are stitched together to form a one-piece seat portion that provides the structure for carrying the weight of the child.

First sleeves 96 are doubled over extensions of the left and right sides 104 and 106. In other words, these extensions extend over the horizontally extending linear tube sections 78 and then down again to be stitched back to their respective sides 104 and 106.

Second sleeve 98 is a doubled over extension of the seat back 108. In other word, an extension of the seat back 108 extends over the upwardly extending linear tube sections 80 and the curved tube sections 82A and 82B and then down again to be stitched back to the seat back 108.

Seat 12 includes a safety harness 109 that includes a front horizontal strap 110 stitched to and between the left and right sides 104, 106. The safety harness 109 further includes a front vertical strap 112 stitched to the seat bottom 100 and extending upwardly to the front horizontal strap 110, where the front vertical strap 112 is doubled over and stitched back to itself to form a loop end that engages the front horizontal strap 110 and where the loop is slideable along the length of the horizontal strap 110. The safety harness 109 further includes a front buckled strap 114 extending generally horizontally to and between the left and right sides 104, 106 and stitched to the left and right sides 104, 106. The safety harness 109 further includes a pair of shoulder straps 116, each of which is stitched to the seat back 108. A proximal end of the shoulder strap 116 includes a quick connector such as a clip that engages a portion of the front buckled strap 114. The safety harness 109 further includes a front vertically running secondary strap 118 that extends from the medial portion of the front buckled strap 114 to the seat bottom 100 to which the front vertically running secondary strap 118 is stitched at or near the location at which the front vertical strap 112 is stitched to the seat bottom 100.

Seat 12 further includes a pair of mesh pockets 120, one of which is stitched to the left side 104 and the other of which is stitched to the right side 106. In particular, mesh pocket 120 is stitched along an upper inside edge of mesh pocket 120 to the first sleeve 96 of its respective side 104, 106. Each of the mesh pockets 120 includes an upper open end.

Seat 12 further includes a back pocket 122 stitched to the seat back 108. Back pocket 122 extends horizontally from generally the left side 104 to the right side 106. Back pocket 122 extends vertically from generally a medial portion of seat back 108 to the seat bottom 100. Back pocket 122 is stitched at its right, left and bottom edges to seat back 108. Back pocket 122 includes an upper open end.

Seat 12 further includes a seat liner 124. Seat liner 124 includes a seat bottom, seat back, right side, and left side. Each of the right and left sides of the seat liner 124 includes a slot for a section of the front buckled strap 114. The seat back of the seat liner 124 includes a pair of slots for the shoulder straps 116. A front portion of the seat bottom of the seat liner 124 includes a strap that forms an opening with a front edge of the seat bottom of the seat liner 124, and the front secondary strap 118 passes through such opening. Seat liner 124 may be removed from the straps 114, 116 and 118 and washed. Quick connect material having hooks and loops, such as Velcro®, may be on surfaces of the seat liner 124 that confront surfaces of the seat bottom 100, right side 104, left side 106, seat back 108, sleeves 96, and sleeve 98 so as to generally hold the seat liner 124 in place.

In operation, each of the base units 22, independently of the seat unit 24, is engaged to the lip 16 of the table top 18, by turning the turn knobs 32 against the underside of the table 20. The base units 22 are spaced apart at approximately the distance between the vertically extending seat tube portions 62, and the exact distance between the vertically extending seat tube portions 62 may be brought about by slightly pivoting one or more of the base units 22 about a vertical axis defined by the turn knob 32. Then the vertically extending seat tube portions 62 are slid at least partially into the vertically extending lower base tube portions 46 where the lower ends of the vertically extending seat tube portions 62 hit the pins 66. At this time, the seat unit 24 may be left as is, hands free, engaged in the base units 22, and attention may be paid to a further adjusting or tightening of the base units 22. Then, still hands free of the seat unit 24, the spring biased pin mechanisms 60 may be operated in unison, one with each hand, to pull out the pins 66 to permit the lower ends of the vertically extending seat tube portions 62 to drop past the pins 66. Then the finger grips 64 may be released to permit the inner ends of the pins 66 to slide against the vertically extending seat tube portions 62 until the pins 66 pop into the lowermost openings 74, or the finger grips 64 may be held until the seat unit 24 is at the desired height, whereupon the finger grips 64 are released to permit the pins 66 to pop into the middle openings 74 or the uppermost openings 74 so as to lock the seat unit 24 to the base unit 22. Then a child may be set down into the seat 12 and buckled into the safety harness 109. The weight of the child in the seat 12 is carried by the cantilevered portions 76. To remove the child from the hook on high chair 10, the safety harness 109 is unbuckled and the child is lifted out. If it is desired to store the seat unit 24 between meal times, the finger grips 64 are pulled out to draw the pins 66 out of the holes 74, and the vertically extending seat tube portions 62 are lifted out of the vertically extending lower base tube portions 46. If desired, the base units 22 can remain on the table 20 or removed by turning the turn knobs 32.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

I claim:

1. A hook on high chair for engaging a lip of a table top of a table, the hook on high chair including no legs that reach to a floor, wherein the hook on high chair comprises:

a) a seat for seating a child;

b) a frame that engages the seat and that engages the lip of the table top;

c) wherein the frame comprises a base unit that engages the lip of the table top;

d) wherein the frame comprises a seat unit that engages the seat;

e) wherein the seat unit is engagable to and disengagable from the base unit such that the base unit can remain at the table while the seat unit that protrudes out into room space can be removed from the table between meal times, such that the seat unit may independently of the base unit be removed from the table, and such that the seat unit may be taken out of the base unit;

f) wherein the table top defines a plane and wherein the seat unit slideably engages the base unit such that the seat unit slides in a direction perpendicularly relative to the plane of the table top such that the seat unit is adjustable in height relative to the base unit and relative to the table top such that the hook on high chair may be customized for relatively small and relatively large children;

g) wherein the base unit includes a vertically extending lower base tube portion, wherein the seat unit includes a vertically extending seat tube portion, and wherein one of the vertically extending lower base tube portion and vertically extending seat tube portion slides within the other of the vertically extending lower base tube portion and vertically extending seat tube portion such that the seat unit is adjustable in height relative to the base unit and relative to the table top;

h) a joint between the vertically extending lower base tube portion and the vertically extending seat tube portion, wherein the joint comprises a spring biased pin, wherein the vertically extending lower base tube portion and vertically extending seat tube portion include alignable openings, wherein the joint fixes the vertically extending lower base tube portion and vertically extending seat tube portion relative to each other when the spring biased pin is engaged in two alignable openings, and wherein the joint permits the vertically extending lower base tube portion and vertically extending seat tube portion to slide relative to each other when the spring biased pin is disengaged from at least one of said two alignable openings;

i) wherein the joint further comprises an axial overlap between the vertically extending lower base tube portion and the vertically extending seat tube portion, wherein the vertically extending lower base tube portion includes an upper end, wherein said axial overlap extends at least a distance between said spring biased pin and said upper end such that the base unit provides a seating for the seat unit before the spring biased pin is engaged in said two alignable openings;

j) wherein said spring biased pin is a stop against a lower end of the vertically extending seat tube portion before the spring biased pin is engaged in said two alignable openings; and k) wherein the base unit further comprises an upper base tube having proximal and distal ends relative to the seat, said lower base tube having proximal and distal ends relative to the seat, a foot engaged to the distal end of the upper base tube, a turn knob engaged to the distal end of the lower base tube and opposing the foot, and said joint engaging the proximal ends of the upper and lower base tubes.

2. The hook on high chair of claim 1, wherein the spring biased pin is generally transverse of the upper base tube.

3. The hook on high chair of claim 1, wherein the spring biased pin includes an axis along which the spring biased pin is pulled relative to said two alignable openings, wherein the upper base tube includes an axis, and wherein said axis of the spring biased pin is generally coaxial with the axis of the upper base tube.

4. The hook on high chair of claim 1, wherein the turn knob is turnable to and away from the distal end of the lower base tube, wherein the turn knob is vertically aligned with the foot, and wherein the foot includes a resilient portion such that, when the turn knob is turned to draw the turn knob and foot towards each other, said resilient portion of the foot is squeezed.

5. The hook on high chair of claim 1, wherein the base unit includes a lower base tube having said vertically extending lower base tub portion, wherein the lower base tube is generally J-shaped such that the lower base tube includes a pair of upwardly extending tube portions, one of which is said vertically extending lower base tube portion, wherein each of the upwardly extending tube portions includes an upper end, and wherein one of the upper ends is offset horizontally relative to the other of the upper ends such that, when the hook on high chair is engaged to the table top, one of the upper ends is disposed at a greater height than the other of the upper ends.

6. The hook on high chair of claim 1, wherein the seat unit comprises:

a) said vertically extending seat tube portion that engages the base unit; and b) a cantilevered portion that engages the vertically extending seat tube portion and projects away from the vertically extending seat tube portion, wherein the cantilevered portion engages the seat such that the seat hangs from the cantilevered portion and such that the cantilevered portion carries a load of the child in the seat.

7. The hook on high chair of claim 6, wherein the cantilevered portion is rigidly fixed to said vertically extending seat tube portion.

8. The hook on high chair of claim 6, wherein the seat includes at least one sleeve, wherein the cantilevered portion includes tube sections engagable to and disengagable from each other, and wherein the cantilevered portion engages said at least one sleeve.

9. The hook on high chair of claim 6, wherein the cantilevered portion is rigidly fixed to said vertically extending seat tube portion at a right angle, wherein the seat includes at least one sleeve, wherein the cantilevered portion includes tube sections engagable to and disengagable from each other, and wherein the cantilevered portion engages said at least one sleeve, such that the seat is slideable off the cantilevered portion when said tube sections are disengaged, and such that the seat is slideable off the seat unit without sliding said sleeve through said right angle.

10. The hook on high chair of claim 6, wherein the cantilevered portion comprises:

a) a horizontally extending tube section rigidly fixed to the vertically extending seat tube portion, wherein the horizontally extending tube section includes a distal end that is distal relative to the vertically extending seat tube portion;

b) an upwardly extending tube section integral and one-piece with the horizontally extending tube section, wherein the upwardly extending tube section extends from the distal end of the horizontally extending tube section, wherein the upwardly extending tube section forms an obtuse angle with the horizontally extending tube section, and wherein the upwardly extending tube section includes a distal end distal relative to the vertically extending seat tube portion; and c) a curved tube section having two ends, wherein one of the ends is slideably engagable with the distal end of the upwardly extending tube section, wherein the other of the ends of said curved tube section is slideably engagable with an end of a curved tube section of another cantilevered portion, and wherein said upwardly extending tube section and said curved tube section are coplanar with each other.

11. A hook on high chair for engaging a lip of a table top of a table, the hook on high chair including no legs that reach to a floor, wherein the hook on high chair comprises:

a) a seat for seating a child;

b) a frame that engages the seat and that engages the lip of the table top;

c) wherein the frame comprises a base unit that engages the lip of the table top, wherein the base unit comprises a lower base tube, wherein the lower base tube is generally J-shaped such that the lower base tube includes a pair of vertically extending lower base tube portions, wherein each of the vertically extending lower base tube portions includes an upper end, and wherein one of the upper ends is offset horizontally relative to the other of the upper ends such that, when the hook on high chair is engaged to the table top, one of the upper ends is disposed at a greater height than the other of the upper ends;

d) wherein the frame comprises a seat unit that engages the seat, wherein the seat unit comprises:

i) a vertically extending seat tube portion that engages one of the upwardly extending tube portions of the base unit; and ii) a cantilevered portion that engages the vertically extending seat tube portion and projects away from the vertically extending seat tube portion, wherein the cantilevered portion engages the seat such that the seat hangs from the cantilevered portion and such that the cantilevered portion carries a load of the child in the seat;

e) wherein the seat unit is engagable to and disengagable from the base unit via said vertically extending seat tube portion and vertically extending lower base tube portion such that the base unit can remain at the table while the seat unit that protrudes out into room space can be removed from the table between meal times, such that the seat unit may independently of the base unit be removed from the table, and such that the seat unit may be taken out of the base unit;

f) wherein the table top defines a plane and wherein the seat unit slideably engages the base unit via said vertically extending seat tube portion and vertically extending lower base tube portion such that the seat unit slides in a direction perpendicularly relative to the plane of the table top such that the seat unit is adjustable in height relative to the base unit and relative to the table top such that the hook on high chair may be customized for relatively small and relatively large children;

g) wherein the base unit comprises an upper base tube and wherein each of the upper and lower base tubes have a proximal end relative to the seat;

h) a joint engaging the proximal ends of the upper and lower base tubes;

i) wherein the vertically extending seat tube portion and vertically extending lower base tube portion include alignable openings, wherein the joint comprises a spring biased pin that is engagable with and disengagable from the alignable openings, wherein the joint fixes the vertically extending lower base tube portion and vertically extending seat tube portion relative to each other when the spring biased pin is engaged in two alignable openings, wherein the joint permits the vertically extending lower base tube portion and vertically extending seat tube portion to slide relative to each other when the spring biased pin is disengaged from at least one of said two alignable openings; and j) wherein the spring biased pin includes an axis along which the spring biased pin is pulled relative to said two alignable openings, wherein the upper base tube includes an axis, and wherein said axis of the spring biased pin is generally coaxial with the axis of the upper base tube.

12. A hook on high chair for engaging a lip of a table top of a table, the hook on high chair including no legs that reach to a floor, wherein the hook on high chair comprises:

a) a seat for seating a child;

b) a frame that engages the seat and that engages the lip of the table top;

c) wherein the frame comprises a base unit that engages the lip of the table top;

d) wherein the frame comprises a seat unit that engages the seat;

e) wherein the seat unit is engagable to and disengagable from the base unit such that the base unit can remain at the table while the seat unit that protrudes out into room space can be removed from the table between meal times, such that the seat unit may independently of the base unit be removed from the table, and such that the seat unit may be taken out of the base unit;

f) wherein the seat unit comprises a vertically extending seat tube portion that engages the base unit and a cantilevered portion that engages the vertically extending seat tube portion and projects away from the vertically extending seat tube portion, wherein the cantilevered portion engages the seat such that the seat hangs from the cantilevered portion and such that the cantilevered portion carries a load of the child in the seat;

g) wherein the cantilevered portion is rigidly fixed to said vertically extending seat tube portion at a right angle;

h) wherein the seat includes at least one sleeve, wherein the cantilevered portion includes tube sections engagable to and disengagable from each other, and wherein the cantilevered portion engages said at least one sleeve such that the seat is slideable off the cantilevered portion when said tube sections are disengaged, and such that the seat is slideable off the seat unit without sliding said sleeve through said right angle; and i) wherein the tube sections of the cantilevered portion comprise:

A) a horizontally extending tube section rigidly fixed to the vertically extending seat tube portion, wherein the horizontally extending tube section includes a distal end that is distal relative to the vertically extending seat tube portion;

B) an upwardly extending tube section integral and one-piece with the horizontally extending tube section, wherein the upwardly extending tube section extends from the distal end of the horizontally extending tube section, wherein the upwardly extending tube section forms an obtuse angle with the horizontally extending tube section, and wherein the upwardly extending tube section includes a distal end distal relative to the vertically extending seat tube portion; and C) a curved tube section having two ends, wherein one of the ends is slideably engagable with the distal end of the upwardly extending tube section, wherein the other of the ends of said curved tube section is slideably engagable with an end of a curved tube section of another cantilevered portion, and wherein said upwardly extending tube section and said curved tube section are coplanar with each other.

* * * * *